US011168861B2

(12) United States Patent
Hermitte et al.

(10) Patent No.: US 11,168,861 B2
(45) Date of Patent: Nov. 9, 2021

(54) LIGHT-EMITTING, NOTABLY LIGHTING AND/OR SIGNALING, MODULE FOR MOTOR VEHICLES

(71) Applicant: VALEO VISION, Bobigny (FR)

(72) Inventors: Michel Hermitte, Angers (FR); Sebastien Bera, Angers (FR); Julian Gueret, Angers (FR)

(73) Assignee: VALEO VISION, Bobigny (FR)

( * ) Notice: Subject to any disclaimer, the term of this patent is extended or adjusted under 35 U.S.C. 154(b) by 101 days.

(21) Appl. No.: 15/715,911

(22) Filed: Sep. 26, 2017

(65) Prior Publication Data

US 2018/0087737 A1 Mar. 29, 2018

(30) Foreign Application Priority Data

Sep. 26, 2016 (FR) ..... 16 59044

(51) Int. Cl.
*F21S 41/663* (2018.01)
*F21S 41/19* (2018.01)
(Continued)

(52) U.S. Cl.
CPC ..... *F21S 41/663* (2018.01); *F21S 41/143* (2018.01); *F21S 41/19* (2018.01); *F21S 41/255* (2018.01);
(Continued)

(58) Field of Classification Search
CPC ..... B60Q 1/0041; B60Q 1/045; B60Q 1/06; B60Q 1/085; B60Q 1/1423; B60Q 1/143; B60Q 1/2696; F21S 41/141; F21S 41/143; F21S 41/19; F21S 41/26; F21S 41/663; F21S 41/147; F21S 41/25; F21S 41/255;
(Continued)

(56) References Cited

U.S. PATENT DOCUMENTS 5,751,832 A * 5/1998 Panter ..... G05B 19/401 356/121
6,547,426 B1 * 4/2003 Ebara ..... F21S 45/33 362/473
(Continued)

FOREIGN PATENT DOCUMENTS

DE 10 2006 020 961 A1 11/2007
EP 1 936 260 A1 6/2008
(Continued)

OTHER PUBLICATIONS

Machine Translation of WO2014124477, retrieved from Espacenet (Year: 2019).*
(Continued)

*Primary Examiner* — Rajarshi Chakraborty
*Assistant Examiner* — Steven Y Horikoshi
(74) *Attorney, Agent, or Firm* — Oblon, McClelland, Maier & Neustadt, L.L.P.

(57) ABSTRACT

Light-emitting module, notably motor vehicle lighting and/or signaling module, including at least two sub-modules each including at least two light sources activatable selectively to each produce a segment of a partial light beam. Also included is a projection optic common to the two sub-modules for projecting said light-emitting segments. The sub-modules and the projection optic being adapted to produce a homogeneous segmented beam.

16 Claims, 2 Drawing Sheets

(51) Int. Cl.

| | |
|---|---|
| ***F21S 41/143*** | (2018.01) |
| ***F21S 41/26*** | (2018.01) |
| *F21S 41/50* | (2018.01) |
| *F21Y 103/10* | (2016.01) |
| *F21S 41/255* | (2018.01) |
| *F21S 43/00* | (2018.01) |
| *F21S 45/47* | (2018.01) |

(52) U.S. Cl.
CPC ..... *F21S 41/26* (2018.01); *F21S 41/50* (2018.01); *F21S 43/00* (2018.01); *F21S 45/47* (2018.01); *F21Y 2103/10* (2016.08)

(58) Field of Classification Search
CPC ..... F21S 41/27; F21S 41/28; F21S 41/151; F21V 5/08; F21W 2102/16; F21W 2102/165
See application file for complete search history.

(56) References Cited

U.S. PATENT DOCUMENTS

2005/0219856 A1 10/2005 Tatsukawa
2006/0044803 A1* 3/2006 Edwards ..... F21V 29/89 362/294
2007/0076422 A1* 4/2007 Nicolai ..... F21S 45/47 362/547
2007/0183168 A1* 8/2007 Naganawa ..... B60Q 1/085 362/545
2008/0151567 A1* 6/2008 Albou ..... F21S 41/663 362/507
2014/0009938 A1* 1/2014 Hossfeld ..... F21S 41/26 362/244
2014/0029287 A1* 1/2014 Anzai ..... F21S 41/663 362/521
2015/0285455 A1* 10/2015 Sudahl ..... F21S 41/29 362/520
2015/0377440 A1 12/2015 Reitegger et al.
2016/0368414 A1* 12/2016 Son ..... F21S 41/143

FOREIGN PATENT DOCUMENTS

| | | | |
|---|---|---|---|
| EP | 2 682 671 | A2 | 1/2014 |
| EP | 2 693 108 | A1 | 2/2014 |
| EP | 3 021 040 | A1 | 5/2016 |
| FR | 2 991 251 | | 12/2013 |
| WO | WO 2014/124477 | A1 | 8/2014 |

OTHER PUBLICATIONS

Machine Translation of EP3021040, retrieved from Epacenet (Year: 2019).*
French Preliminary Search Report dated May 18, 2017 in French Application 16 59044 filed on Sep. 26, 2016 (with Translation of Categories Cited Documents).

* cited by examiner

LIGHT-EMITTING, NOTABLY LIGHTING AND/OR SIGNALING, MODULE FOR MOTOR VEHICLES

The field of the present invention is that of light-emitting modules for motor vehicles and notably lighting and/or signaling modules.

A motor vehicle is equipped with headlights, or headlamps, intended to light the road in front of the vehicle, notably at night or during inclement weather. These headlights can generally be used in accordance with two lighting modes: a first "high beam" mode and a second "low beam" mode. The "high beam" mode enables the road to be brightly lit far in front of the vehicle, at the risk of dazzling users of the road approaching in the opposite direction. The "low beam" mode produces more limited lighting of the road, but nevertheless offers good visibility, without dazzling the other users of the road. These two lighting modes are complementary. The driver of the vehicle must change mode manually as a function of the lighting conditions and the other users of the road. The fact of having to change mode manually can lack reliability and prove dangerous under certain conditions. Moreover, the high beam mode sometimes results in unsatisfactory visibility for the driver of the vehicle.

To improve on the situation, headlights provided with an ADB (Adaptive Driving Beam) adaptive lighting function have been proposed. An ADB function of this kind is intended to detect automatically a user of the road liable to be dazzled by a lighting beam emitted in high beam mode by a headlight and to modify the contour of that lighting beam in such a manner as to create a shadow zone at the location of the detected user. The ADB function has multiple advantages: user friendliness, better visibility compared to low beam mode lighting, more reliable mode changing, greatly reduced risk of dazzle, safer driving.

In order to implement an ADB function of this kind there is for example known a system comprising a plurality of light sources, a primary optical element and an associated projection optical element forming a secondary optic, in which system the primary optical element comprises a plurality of light guides having contiguous outlet edges, the outlets of the guides of the primary optical element being positioned in an object focal plane of the secondary optic.

The light-emitting by each light source enters the associated light guide, where applicable propagates inside a corrective part common to each guide, and is then emitted via the outlet face of the corrective part toward the associated secondary optical element. The light emitted by each optical guide outlet zone and projected by the secondary optical element forms in front of the vehicle a vertical light-emitting segment. The light sources can be lit independently of one another, in a selective manner, to produce the required lighting effect.

A lighting system of this kind nevertheless has certain disadvantages. In particular, because of the use of a plurality of light guides disposed in series to form the primary optical element of a system of this kind, industrialization is made difficult.

In this context, the present invention aims to propose a light-emitting module the assembly and the adjustment of which are simplified.

The present invention concerns a light-emitting module including on the one hand at least two sub-modules each including at least two light sources activatable selectively so that each produces a light-emitting segment and on the other hand a projection optic common to the two sub-modules for projecting said light-emitting segments, the sub-modules and the projection optic being adapted to produce a homogeneous segmented beam when all the segments are activated together.

The light-emitting module according to the invention therefore makes it possible to implement a Matrix Beam function in a compact manner using a single light-emitting module.

The sub-modules of the light-emitting module according to the invention can comprise the same number of light sources or comprise a different number of light sources.

Each sub-module includes a separate support for its light sources.

According to one feature of the invention, the light-emitting module includes a plate for supporting the sub-modules. The sub-modules can in particular be disposed at one end of the plate and the projection optic at an opposite end of the plate.

The support of at least one sub-module includes a front face carrying the at least two light sources and a rear face configured to come into contact with a wall of the plate, and notably against the front face of that wall. In order to provide for this contact, the rear face of the support of the sub-module and/or the front face of the wall of the plate can in particular include at least one plane portion.

The support takes substantially the form of a thin plate defined between this front face and the rear face. Each sub-module can include a support of this type.

Each sub-module is fixed to the plate by fixing means. Each sub-module can be fixed by screwing, gluing, riveting, crimping or any other appropriate fixing means.

In particular, the sub-modules can be screwed to the plate to fix them to it and to this end the plate includes at least one orifice and each support includes a bore associated with one of the orifices in the plate. Each orifice/bore pair is intended to receive a fixing screw, and the orifice in the plate or the bore in the support have a section larger than that of the fixing screw. The head of the screw is on the side of the orifice that has the largest section. Screwing can therefore be effected from the front or from the rear as a function of which orifice has the largest section.

The sub-modules are adapted to be adjusted in rotation and/or in translation independently of one another to produce a homogeneous beam. The source supports are more particularly adapted to be adjusted in rotation independently of one another to produce this homogeneous beam.

The support includes at least one holding finger. The holding finger enables manipulation of the sub-module to adjust it. The manipulation to adjust the sub-module can be effected either by a human operative or by a machine, automatically or otherwise.

Each sub-module includes a plurality of light sources configured to form a segmented partial light beam. The light-emitting segments of a partial light beam emitted by a sub-module are side by side two by two.

According to the invention, each of the sub-modules is adjusted so that the light-emitting segments corresponding to a sub-module are side by side with the light-emitting segments corresponding to the adjacent sub-module or in such a manner that the light-emitting segments corresponding to one sub-module are interleaved with the light-emitting segments corresponding to another sub-module. Thus the light-emitting segments can be interleaved with the light-emitting segments of an adjacent sub-module or not, and this interleaving makes it possible to produce an overlapping of light-emitting segments, making possible selective lighting of strips of the global light beam projected by the light-emitting module with a luminous intensity evolving progressively on either side of the strip or strips left unlit. The overlap of the light-emitting segments can have a width of l/n, l being the width of the light-emitting segment and n being the number of sub-modules, but other examples of overlapping can be envisaged.

This feature notably makes it possible to provide the possibility of producing a segmented high beam in a single module of simple design with a single projection optic with a plurality of independent sub-modules that can be adjusted independently of one another.

The light-emitting module can further comprise a control device adapted selectively to activate or to deactivate one or more light-emitting segments. The selective activation of one or more light-emitting segments can be effected by the user or automatically in conjunction with a detection system.

The light-emitting segments are oriented vertically or in an essentially vertical manner. By essentially vertical is meant that the light-emitting segments can have an angle relative to a vertical axis between 0 and 20° inclusive.

The module can further include at least one optical element in the vicinity of the light sources and forming a primary optic adapted to cooperate with the single projection optic to form a secondary optic, the optical assembly making it possible to produce the light-emitting segments. In particular the optical element forming the primary optic can be disposed in each sub-module.

The primary optics are situated facing the sources. They can take the form of microlenses. The light-emitting module more particularly includes as many microlenses as light sources, each light source collaborating with one microlens.

The light-emitting module further includes at least one projection lens. This projection lens is adapted to project the light-emitting segments emitted by the sub-module. This projection lens can optionally be curved.

The light-emitting module can include at least one field lens. The field lens can include a plurality of portions each defining one lens for correcting optical aberrations of the projection lens. The optical aberrations that the field lens or one of its portions can correct notably include for example and not by limitation chromatic aberrations and geometric aberrations. The field lens is positioned on the plate.

The light-emitting module can further include at least one separator between the sub-modules. The separator or separators are adapted to prevent unwanted rays passing from one sub-module to the other. The separator or separators are positioned on the plate.

According to the invention, to produce a homogeneous segmented beam the light sources collaborate with at least one of the following elements: the primary optics, the field lens, the separators and the projection lens.

The invention also concerns a method of assembling a light-emitting module as described above in which the position of at least one sub-module is adjusted to produce a homogeneous segmented beam when all the light sources are lit. The method includes at least the following steps:

- the sub-modules are assembled on the plate in a theoretical position, notably by partially tightening fixing means specific to each sub-module,
- a first test phase is effected to determine if the segmented beam is homogeneous and a new recomputed position of at least one sub-module is defined,
- the fixing means of at least one sub-module are partially loosened,
- the sub-module is caused to pivot by means of the holding finger and a second test phase is effected to determine if the segmented beam is homogeneous,
- the fixing means specific to each sub-module are tightly clamped to the plate of the light-emitting module.

A gripper controlled by the photometry bench can grip the support of the sub-module to adjust it. The sub-module is gripped by the holding finger specific to each sub-module. The gripping can more particularly be effected by means of a gripping hole disposed in the holding finger. The gripping hole is adapted to allow gripping by the required adjustment tool. The adjustment of the sub-module is effected by rotation about a vertical axis, a transverse axis and/or a plane defined by these two axes.

In the method such as has just been described, one or more steps of the method can be effected in an automated manner.

Other features, details and advantages of the invention will emerge more clearly on reading the description given hereinafter by way of example and with reference to the drawings, in which.

The embodiments that are described hereinafter are in no way limiting on the invention: variants of the invention could in particular be conceived of that comprise only a selection of the features described hereinafter in isolation from the other features described if that selection of features is sufficient to confer a technical advantage or to distinguish the invention from the prior art.

In particular all the variants and all the embodiments described can be combined with one another if there is nothing to oppose that combination from a technical point of view. In such cases, this will be mentioned in the present description.

In the figures, elements common to more than one figure retain the same reference.

In the remainder of the description, the terms longitudinal, vertical and transverse are relative to an axis corresponding to the general direction of the rays emitted by the light source. The longitudinal direction corresponds to the general direction of the rays emitted by the light source. The forward direction designates the direction of emission of the light rays by the light source, the reverse direction for its part designating the opposite direction. The directions referred to above can also be seen in a trihedron L, V, T shown in the figures.

The light-emitting module 1 according to the invention includes at least two sub-modules 2 each including at least one light source 3 (visible in FIG. 2 in particular), together with a projection optic 4 common to the at least two sub-modules 2.

Figure 1:
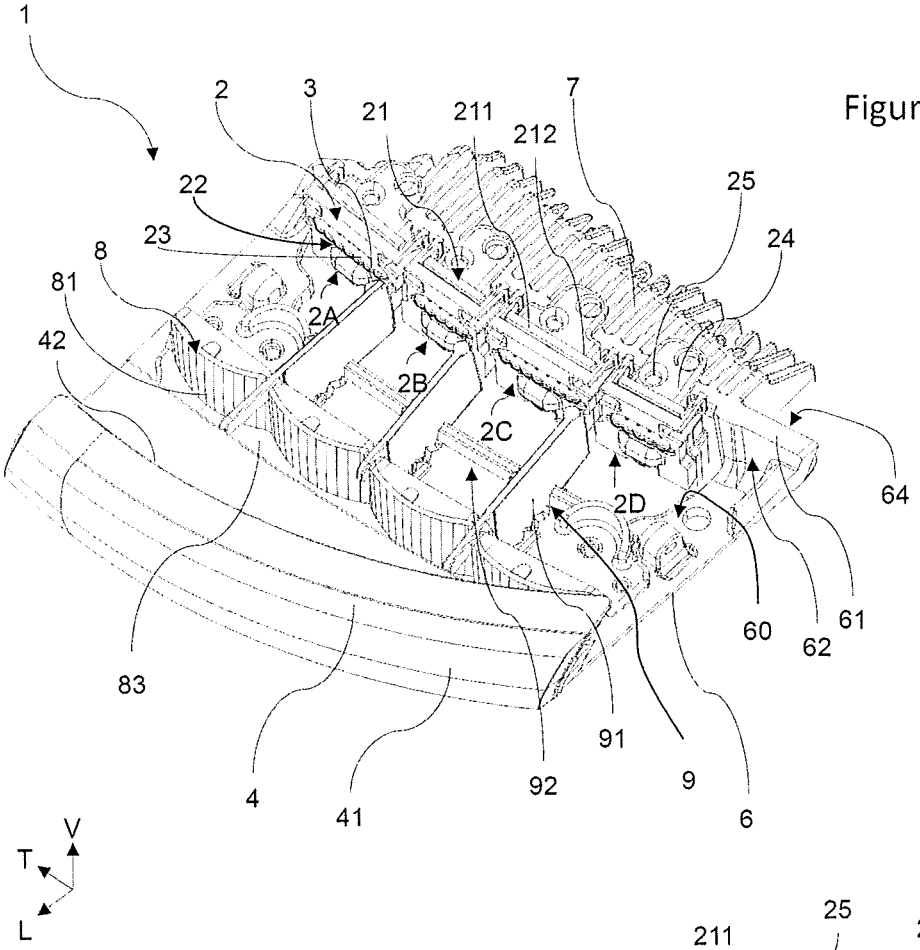
FIG. 1 is a perspective view of a light-emitting module according to the invention including four sub-modules and the respective plurality of light sources thereof.

In the example shown the light-emitting module it according to the invention more particularly includes four sub-modules 2. Two sub-modules 2 include five light sources 3, the other two sub-modules 2 including seven light sources 3 in the FIG. 1 example the sub-modules including five light sources alternate with those including seven light sources.

The light-emitting module 1 further includes a plate 6 that has a first face 60 on which are disposed the various elements constituting the light-emitting module 1. The sub-modules 2 are disposed at a first longitudinal end of the plate 6 whereas the projection optic 4 of the light-emitting module 1, which is common to each of the sub-modules, is disposed at an opposite longitudinal end of the plate 6, opposite the sub-modules 2.

Here the projection optic 4 consists in a curved projection lens with an entry face 41 facing toward the light sources 3 and the associated sub-modules and an exit face 42. The projection optic 4 is common to each sub-module 2 and for controlled projection of the light rays emitted by the light sources 3 it collaborates with the light sources 3 and the optical elements associated with the light sources and forming primary optics 22.

The plate 6 includes at the first longitudinal end, for fixing the sub-modules 2, a vertical wall 61 extending the plane base of the plate. The sub-modules 2 are disposed on a front face 62 of this vertical wall 61, i.e. the face facing the projection optic 4. The front face 62 of the vertical wall 61 of the plate 6 is plane or substantially plane.

The plate 6 further includes a heatsink 7 on a rear face 64 of the vertical wall 61 of the plate 6, said rear face 64 being disposed opposite the front face 62 on which are disposed the sub-modules 2. The heatsink 7 is adapted to dissipate effectively the heat generated by the light sources 3 and the electronic components carried by the sub-modules 2. In the FIG. 1 example, the heatsink 7 comprises a multitude of fins disposed vertically, but it can advantageously be differently arranged.

In the example shown, the light-emitting module further includes a field lens 8 and a separator 9 also arranged on the plate 6 of the module between the plurality of sub-modules 2 and the projection optic common to each of the sub-modules in such a manner as to deflect, segment and conform the rays emitted by the light sources carried by the sub-modules to direct them in an appropriate manner to the common projection optic at the exit of the module.

Figure 2:
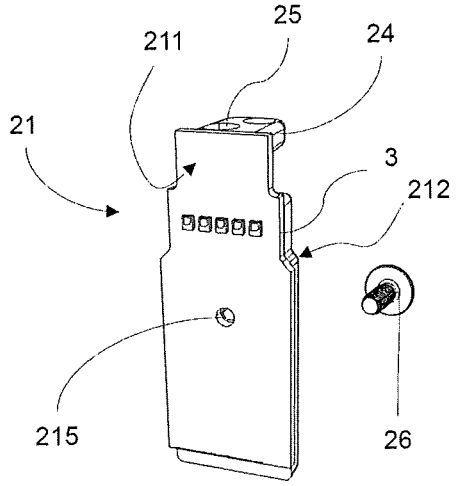
FIG. 2 is a perspective view of a light source support included in a sub-module according to one embodiment of the invention.

The sub-modules 2 each include a support 21 which, as can be seen in FIG. 2 in particular, has a front face 211 and a rear face 212, defining between them the thickness of the plate forming the support 21, as well as a lower part and an upper part defined in the vertical direction as a function of the final arrangement in the vehicle. The light sources 3 of the sub-modules are disposed on the front face 211 of the support 21 and these light sources 3 are aligned transversely in the upper part of the support 21.

Each sub-module 2 further includes an optical element 22 facing the light sources and configured to cooperate with the projection optic common to all the sub-modules, this common projection optic then forming a secondary optic cooperating with the optical element forming a primary optic 22 carried by the sub-modules to generate a lighting and/or signaling light beam. The primary optic 22 is disposed facing each of the light sources 3, between the light sources 3 and the projection optic 4 forming the secondary optic. The primary optic 22 includes at least one microlens 23, and preferably one microlens 23 per light source 3. The microlenses 23 can in particular have a hemispherical or essentially hemispherical shape. They are made of a transparent or translucent material or alloy. For controlled projection of the light rays emitted by the light sources 3 in the direction of the secondary optic in such a manner as to produce segmented partial light beams 5 they are shaped and arranged to collaborate with the light sources 3.

Controlled projection of the rays means that a beam made up of rays is produced at the exit of the module that conforms to the specifications and to the regulations in terms of shape, color and power. The rays projected in a controlled manner have few or no chromatic aberrations.

In the assembled module, the rear face 212 of a support 21 is pressed against the front face 62 of the vertical wall 61 of the plate 6.

Each support 21 of a light source 3 has a threaded bore 215 passing through it, essentially at the center of the support 21. Each threaded bore 215 is more particularly substantially at the center of the support 21 and extends from one face of the support 21 to the other.

In a corresponding manner, the plate 6 further comprises an orifice configured on the vertical wall 61 for each support 21, the orifices being disposed in transverse series. By disposed in series is meant that the orifices are aligned or essentially aligned along a transverse axis, in such a manner as to correspond to the threaded bores 215 in the supports 21 of the light sources 3.

When the support 21 of a light source 3 is mounted on the plate 6, the threaded bore 215 in the support 21 and the orifice in the plate are aligned, in such a manner as to allow fixing means 26 to pass through them. In the situation shown in FIG. 1, the fixing means 26 consists in a clamping screw, the shank diameter of which is substantially equal to that of the threaded bores 215. Clearly the diameter of the orifices formed in the vertical wall is slightly greater than that of the threaded bores 215 in order to be sure not to block the passage of the fixing screw 26 through the bores. In the FIG. 1 example, all the threaded bores 215 have the same diameter, but the diameter of one or more threaded bores 215 can be different from the others. Likewise, although all the orifices formed on the vertical wall 61 can have the same diameter, it can be envisaged that the diameter of one or more of these orifices is different from the others.

The fixing screws 26 are inserted through the rear face 64 of the vertical wall 61 of the plate, and they pass through the orifices in the plate to be inserted in the threaded bores 215 of the supports 21, the screwheads therefore remaining on the side of the rear face 64 of the vertical wall 61.

The supports 21 each include at least one holding finger 24 that perpendicularly extends the support by virtue of projecting on the rear face 212 of the latter, being arranged at one end of this support, here in the vicinity of the upper edge. Each holding finger 24 comprises at least one gripping hole 25, arranged to allow gripping and manipulation of the supports 21 by an operator or a machine in order to produce the rewired orientation of each support before fixing them in the light-emitting module. In the example shown, the holding finger includes two gripping holes 25, configured to collaborate with any machine tool useful for the manufacture, assembly or adjustment of the light-emitting module 1.

As described above, the field lens 8 is disposed on the plate 6, between the sub-modules 2 and the projection optic 4. The field lens 8 is divided into a plurality of portions 81 each defining an optical aberration correction lens specifically associated with one of the sub-modules and projecting substantially perpendicularly from a base 83 of the field lens 8, in such a manner as to be located on the path of the rays emitted by the light sources in the direction of the projection lens 4. Therefore, each portion 81 of the field lens 8 collaborates with a sub-module 2 and with the projection optic 4 to project in a controlled manner the light rays emitted by the light sources 3.

The light-emitting module 1 according to the invention also comprises a separator 9 configured to divide the rays emitted by the light sources into a plurality of successive strips, and notably to intercept unwanted rays emitted by the sub-modules 2. These unwanted rays are light rays emitted by the light sources 3 of a sub-module 2 with a trajectory that deviates significantly from the general axis of the light rays, the unwanted rays being liable to interfere with the optimum operation of the adjacent sub-modules 2. The separator 9 is formed of or covered with an opaque material able to absorb light rays.

The separator 9 for its part is also disposed on the plate 6, between the sub-modules 2 and the field lens 8. The separator 9 comprises longitudinal walls 91 arranged in transverse series and that respectively extend between the portions 81 of the field lens 8 and between the sub-modules 2. The separator therefore makes it possible to define light distribution conduits 92, leading from a sub-module 2 disposed at one longitudinal end of the separator to a field lens disposed at the opposite longitudinal end. Unwanted rays emitted by the light sources 3 of a sub-module 2 are absorbed by the longitudinal walls 91 of the distribution conduits 92, and the majority of the light rays emitted by each sub-module 2 are directed toward the corresponding portion 81 of the field lens and then projected in a controlled manner toward the projection optic 4, common to each distribution conduit 92.

Figure 3:
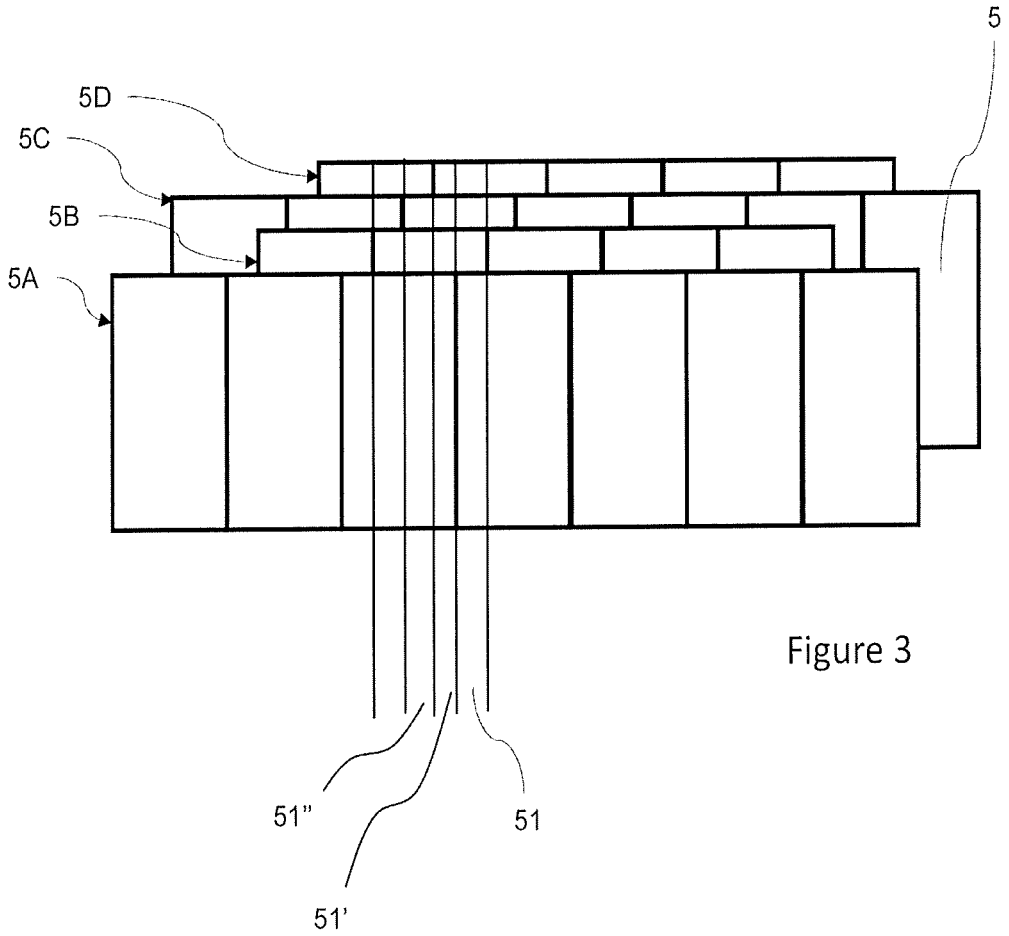
FIGS. 3 and 4 are diagrammatic representations of a global light beam projected by a light-emitting module from FIG. 1 and a luminous intensity diagram of that beam when one strip forming the beam is unlit.

This results in the production of a segmented light beam at the exit of the light-emitting module as can be seen in FIG. 3 in particular.

Each sub-module 2 (designated 2A to 2D in FIG. 1) therefore participates in the creation of a partial light beam (designated 5A to 5D in FIG. 3) projected at the exit of the common projection lens, and each partial light beam is segmented because of the series arrangement of a plurality of light sources in each sub-module.

In the example shown, two non-consecutive sub-modules 2A and 2C include seven light sources and seven associated microlenses and the partial light beams 5A and 5C that they participate in projecting include seven segments, whereas the other two sub-modules 2B and 2D, consequently also non-consecutive, include five light sources and five associated microlenses so that the partial light beams 5B and 5D that they participate in projecting include five segments.

The light-emitting segments of a partial light beam are side by side two by two, and these various partial light beams 5A, . . . , 5D projected at the exit from the common projection optic are interleaved, so that in the global light beam 5, constructed by the addition of the partial beams, a lighting strip 51 can be constituted, notably at the center of the global beam, by the superposition of a plurality of light-emitting segments respectively belonging to one of the partial light beams. In other words, the light-emitting segments of one sub-module are interleaved with the light-emitting segments of another sub-module.

A light strip 51 can therefore be illuminated or not as a function of the lighting or not of such or such a segment, and the luminous intensity of this lighting strip can be varied as a function of the number of light-emitting segments that constitute it that are lit.

In the example shown in FIG. 3, each strip 51 is therefore constituted of a part of four different light-emitting segments, each resulting from a partial light beam 5 produced by the cooperation of a specific sub-module and the common projection optic and separate sub-module.

In normal operation, when the vehicle is the only one traveling, all of the light sources 3 are lit. The light-emitting module 1 therefore lights the road taken by the vehicle to the maximum of its capacities. In the event of another user arriving, whether that be a pedestrian, a vehicle arriving in the opposite direction or a vehicle preceding that of the user, it is possible selectively to deactivate certain light sources 3 in such a manner as no longer to project certain light-emitting segments of the partial light beam. This has the effect of deactivating certain strips 51, notably those that it has been possible to identify as participating in lighting the user detected on the road scene, and to modify the lighting contour of the global light beam projected by the user's vehicle, in order not to dazzle the other users.

By way of nonlimiting example, it is possible to detect a vehicle arriving in the opposite direction in a straight line, substantially at the center of the lighting beam, and it is then necessary to extinguish the lighting strip 51 shown in FIG. 3. Each of the light sources 3, in a light-emitting sub-module 2, corresponding to the lighting of this lighting strip is then extinguished. In the example shown, there is therefore extinguished the fourth source of the first sub-module 2A, generating the first partial light beam 5A, and there are simultaneously extinguished the second source of the second sub-module 2B, generating the second partial light beam 5B, the third source of the third sub-module 2C, generating the third partial light beam 5C, and the second source of the fourth sub-module 2D, generating the fourth partial light beam 5D.

Figure 4:
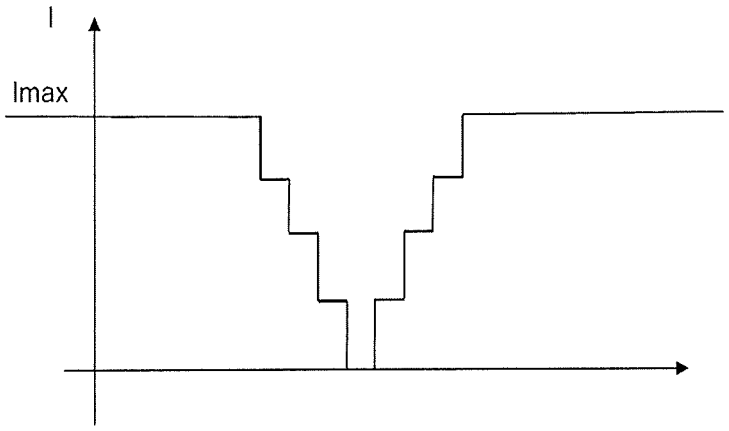

There has been shown in FIG. 4 the luminous intensity profile of the resulting global light beam. It can be seen that the lighting strip 51 in which the third party vehicle has been detected is completely extinguished and that the lighting strips in the vicinity thereof have a luminous intensity increasing progressively in the direction away from the extinguished lighting strip. This prevents excessively strong contrast between the extinguished strip and the rest of the lighting beam, which could compromise the view of the driver.

In the example shown, it is clear that the light-emitting strip 51' directly in the vicinity of the extinguished lighting strip 51 is formed by the same second source of the second sub-module 2B, the third source of the third sub-module 2C, and the second source of the fourth sub-module 2D, which are therefore extinguished, as well as by the third source of the first sub-module 2A, generating the first partial light beam 5A, which for its part has remained lit, selectively relative to the fourth source of the first sub-module 2A. The result of this is that the light-emitting strip 51' directly in the vicinity of the extinguished light strip 51 is lit with a luminous intensity substantially corresponding to one quarter of the maximum luminous intensity.

Likewise, the second light-emitting strip 51" disposed directly in the vicinity of the partially lit light-emitting strip 51' is formed by the same second source of the second sub-module 2B and the third source of the third sub-module 2C as the extinguished lighting strip, as well as by the third source of the first sub-module 2A, generating the first partial light beam 5A, and the first source of the fourth sub-module 2D, which for their part have remained lit, selectively relative to the fourth source of the first sub-module 2A and the second source of the fourth sub-module 2D. The result of this is that this second light-emitting strip 51" is lit with a luminous intensity substantially corresponding to half the maximum luminous intensity.

This progressive evolution of the luminous intensity of the lighting strips is made possible by the segmentation of each of the partial light beams 5A, . . . , 5D, and the selective activation of the light sources generating these partial light beams, by the superposition of all the partial light beams in a homogeneous global light beam when all the segments are lit together, and by the angular offsetting of each partial light one relative to one another so that the segments of one sub-module are interleaved with the segments of the adjacent sub-module.

It is clear that the segmentation of each of the partial light beams is notably made possible by the presence of a plurality of light sources in each sub-module, these light sources being activatable independently of one another.

The superposition of all the partial light beams in a homogeneous segmented global light beam is made possible by the presence of a projection optic common to each of the sub-modules, the projection optic being configured to have on the path of the rays emitted by each sub-module a section adapted to correct the rays to obtain a homogeneous output beam. As it has been possible to describe, it can be interesting to provide between the sub-modules and the common projection optic optical elements participating in correctly dividing the rays in order to prevent unwanted rays that could degrade the homogeneous character of the global light beam projected at the exit of the light-emitting module.

And the angular offsetting of each partial light beam one relative to the other is made possible by a specific angular positioning of each of the sub-modules 2 relative to the plate 6 and notably relative to the vertical wall 61. There is described hereinafter a method of adjusting the position of the sub-modules in the light-emitting module. The aim will notably be to position each sub-module correctly relative to the others so that the overlapping of the light-emitting segments of one sub-module by those of an adjacent sub-module has a required width, the width being equal to l/n, with l the width of the light-emitting segment and n the number of sub-modules.

In the example shown in which the aim is to extinguish in the global light beam one or more successive light-emitting strips so as not to dazzle a third party vehicle, it is clear that the position of the light-emitting strip or strips that it is wished to extinguish could be made to evolve: as the distance between the vehicles decreases, the vehicle approaching from in front will move toward the outside of the global light beam projected by the user's vehicle. It is then required to extinguish successively the first light-emitting strip 51' then the second light-emitting strip 51", and to this end each of the light sources participating in the formation of that light-emitting strip is extinguished, leaving the other light sources lit.

The example described here of lighting and extinguishing light sources to generate a dark strip that does not dazzle a vehicle approaching in the opposite direction is in no way limiting on the invention and the module according to the invention can be used effectively in numerous situations.

There has been mentioned hereinabove the benefit in accordance with the invention of being able to adjust the angular position of the sub-modules 2 relative to one another and there is described hereinafter one example of assembly and adjustment of the light-emitting module 1.

There is effected on the one hand the assembly of the sub-modules 2, by assembling together the components of the sub-modules 2, notably by fixing the light sources 3 to the support 21 in a transverse series and then fixing the optical element 22 to the support 21 so that the microlenses 23 are disposed facing the light sources.

On the other hand, all of the components of the light-emitting module 1 are positioned on the plate 6, in particular placing from one longitudinal end of the plate to the other, in particular the projection lens 4, the field lens 8 and the separators 9.

Each of the sub-modules 2 is then placed on the vertical wall 61 of the plate 6, and these sub-modules are fixed independently of one another with a fixing screw 26 specific to each sub-module. As it has been possible to describe hereinabove, a sub-module is placed against the vertical wall, notably by manipulating the sub-module by means of the holding finger 24, pressing the rear face 212 of a support 21 against the front face 62 of the vertical wall 61 and lining up the threaded bore 215 in the support 21 with the corresponding orifice produced in the vertical wall 61. In particular indexing means can be provided to facilitate the positioning of the support 21 and the lining up of the orifices.

Once each sub-module has been mounted on the plate 6, a test is carried out on a photometry bench to verify that the segments are correctly superposed relative to one another.

If the position of one of the sub-modules must be modified as a function of the results of this test, the fixing means 26 are partially unscrewed to enable the sub-module to move relative to the vertical wall of the plate and a robot is controlled to manipulate the sub-module in rotation about an axis substantially parallel to the vertical wall 61, using the holding finger. Alternatively, the robot can be controlled to manipulate the sub-modules 2 in translation, for example in the directions T and V. As soon as the recomputed position for each sub-module is obtained, the fixing screw 26 is tightened again to press the support 21 of the sub-modules 2 against the vertical wall 61 of the plate 6, holding the recomputed position of the sub-module by means of the holding finger. And this series of operations is repeated for each of the sub-modules the position of which is to be adjusted.

It should be noted that additional steps can be provided, notably a step of adjustment of the projection optic 4, the field lens 8 or the separator 9, to improve the projection of the global light beam produced by the light-emitting module 1 according to the invention.

The invention described hereinabove notably makes it possible to produce a matrix beam with a light-emitting module 1 carrying on a plate a projection optic common to a plurality of sub-modules, easy to assemble independently of the plate, and easy to adjust.

The invention claimed is:

1. A light emitting module including:

at least two sub-modules each including at least two light sources activatable selectively so that each produces a segment of a partial light beam;

a projection optic common to the at least two sub-modules for projecting light emitting segments, the at least two sub-modules being adapted to be adjusted in rotation and/or in translation to produce a homogeneous segmented beam; and a field lens disposed between the at least two sub-modules and the projection optic, the field lens being divided into a plurality of portions that are disposed on a same side of a base of the field lens, each portion defining an optical aberration correction lens associated with one of the at least two sub-modules, the optical aberration correction lenses projecting perpendicularly from the same side of the base of the field lens, wherein each sub-module of the at least two sub-modules includes at least two microlenses positioned in a vicinity of the at least two light sources and forming a primary optic adapted to cooperate with the projection optic to form the homogeneous segmented beam, each of the at least two microlenses facing a respective light source of the at least two light sources of each sub-module, and wherein the field lens is arranged so to as to be closer to the projection optic than the primary optics.

2. The light emitting module according to claim 1, wherein each sub-module includes a separate support for its light sources.

3. The light emitting module according to claim 2, wherein the light emitting module includes a plate disposed to support the at least two sub-modules and the projection optic.

4. The light emitting module according to claim 3, wherein the separate support of at least one sub-module includes a front face carrying the at least two light sources and a rear face configured to be in contact with a wall of the plate.

5. The light emitting module according to claim 4, wherein the plate includes at least one orifice cooperating with a bore produced in the separate support, to receive a fixing screw.

6. The light emitting module according to claim 3, wherein the plate includes at least one orifice cooperating with a bore produced in the separate support, to receive a fixing screw.

7. A method of assembling a light emitting module according to claim 3, wherein at least one sub-module is adjusted in position to obtain a homogeneous segmented beam when all of the at least two light sources are lit, the method comprising:

assembling the at least two sub-modules on the plate in a theoretical position, notably by partially tightening to fix each sub-module, determining, by a first test phase, when the segmented beam is homogeneous, fixing at least one sub-module that is partially loosened, defining a new recomputed position of at least one sub-module, causing, by a holding finger, the sub-module to pivot and/or to move in translation, and determining, by a second test phase, when the segmented beam is homogeneous, and fixing each sub-module that is tightly clamped to a plate of a light-emitting segment.

8. The light emitting module according to claim 3, wherein support of at least one sub-module includes a front face carrying the at least two light sources and a rear face configured to be in contact with a wall of the plate.

9. The light emitting module according to claim 2, wherein the separate support includes a holding finger.

10. The light emitting module according to claim 9, wherein the holding finger is configured to enable manipulation of the sub-module to adjust it.

11. The light emitting module according to claim 2, wherein the light emitting segments of a partial light beam emitted by a sub-module are interleaved with the light emitting segments of a partial light beam emitted by an adjacent sub-module.

12. The light emitting module according to claim 1, wherein the light emitting segments of a partial light beam emitted by a sub-module are interleaved with the light emitting segments of a partial light beam emitted by an adjacent sub-module.

13. The light emitting module according to claim 12, wherein an overlap of the light emitting segments has a width l/n, l being a width of a light-emitting segment and n being a number of sub-modules.

14. The light emitting module according to claim 1, wherein the projection optic includes a curved projection lens for projecting the light emitting segments emitted by the at least two light sources.

15. The light emitting module according to claim 1, wherein the at least two sub-modules are configured to generate a luminous intensity profile including an extinguished lighting strip corresponding to a location of an object, and one or more lighting strips adjacent to the extinguished lighting strip have a luminous intensity increasing progressively in a direction away from the extinguished lighting strip.

16. A light emitting module including:

at least two sub-modules each including at least two light sources activatable selectively so that each produces a segment of a partial light beam, a projection optic common to the two sub-modules for projecting light-emitting segments, and a separator disposed between the at least two sub-modules, the separator extending from the at least two sub-modules to field lenses associated with each of the at least two sub-modules, the separator being configured to define distribution conduits, the sub-modules and the projection optic being adapted to produce a homogeneous segmented beam.

* * * * *